US007908961B2

(12) United States Patent
Kamenz et al.

(10) Patent No.: US 7,908,961 B2
(45) Date of Patent: Mar. 22, 2011

(54) LOCKING DEVICE FOR LINEAR ACTUATORS

(75) Inventors: Milan Kamenz, Braunschweig (DE); Gunther Alvermann, Wendeburg (DE)

(73) Assignee: Duetsches Zentrum Fuer Luft-und Raumfahrt E.V., Cologne (DE)

( * ) Notice: Subject to any disclaimer, the term of this patent is extended or adjusted under 35 U.S.C. 154(b) by 360 days.

(21) Appl. No.: 11/573,516

(22) PCT Filed: Aug. 11, 2005

(86) PCT No.: PCT/DE2005/001420

§ 371 (c)(1),
(2), (4) Date: Jul. 26, 2007

(87) PCT Pub. No.: WO2006/015587

PCT Pub. Date: Feb. 16, 2006

(65) Prior Publication Data

US 2008/0022849 A1 Jan. 31, 2008

(30) Foreign Application Priority Data

Aug. 11, 2004 (DE) ..... 10 2004 039 092

(51) Int. Cl.
*F15B 15/26* (2006.01)
*F01B 3/00* (2006.01)

(52) U.S. Cl. ..... 92/23; 92/26; 92/113

(58) Field of Classification Search ..... 92/19, 23, 92/26, 109, 113
See application file for complete search history.

(56) References Cited

U.S. PATENT DOCUMENTS

| | | | | |
|---|---|---|---|---|
| 2,210,532 | A * | 8/1940 | Feucht | 92/26 |
| 2,879,746 | A * | 3/1959 | Geyer et al. | 92/19 |
| 3,182,565 | A * | 5/1965 | Millard | 92/24 |
| 4,240,334 | A * | 12/1980 | Crosser | 92/23 |
| 5,685,141 | A * | 11/1997 | Markstein et al. | 92/19 |
| 7,013,792 | B2 * | 3/2006 | Yamaguchi | 92/19 |

FOREIGN PATENT DOCUMENTS

| | | |
|---|---|---|
| DE | 1206316 | 12/1965 |
| DE | 3133117 | 3/1983 |
| DE | 3307644 | 9/1984 |
| DE | 3807669 | 9/1989 |
| DE | 29503736 | 4/1995 |
| DE | 19507689 | 9/1996 |
| DE | 19806501 | 8/1999 |

* cited by examiner

*Primary Examiner* — Michael Leslie
(74) *Attorney, Agent, or Firm* — Andrew M. Calderon; Roberts Mlotkowski Safran & Cole, P.C.

(57) ABSTRACT

The invention relates to a locking device for linear actuators, in particular for fluid-actuated adjusting devices, with a piston rod mounted in an axially displaceable manner relative to a receiving device. The object of the invention is to provide a locking device for linear actuators, with which a secure locking is possible over the entire travel path of the linear actuators. This is attained in that the piston rod has a hollow space extending in the axial direction, in which form-fitting devices are arranged distributed in the axial direction, that form-fitting elements corresponding to the form-fitting devices are arranged in the piston rod in a radially displaceable manner, which elements are mounted in an axially stationary manner relative to the receiving device, and that an actuating device that displaces the form-fitting elements radially is assigned to the form-fitting elements.

24 Claims, 3 Drawing Sheets

LOCKING DEVICE FOR LINEAR ACTUATORS

BACKGROUND OF THE INVENTION

1. Field of the Invention

The invention relates to a locking device for linear actuators, in particular for fluid-actuated adjusting devices, with a piston rod mounted in an axially displaceable manner relative to a receiving device. The invention is suitable in particular for hydraulic adjusting devices that are used for safety-critical applications.

2. Discussion of Background Information

From prior art, hydraulic lockings in the form of a flow check valve are known for hydraulic adjusting devices. In particular for safety-critical applications in aviation, flow check valves for locking the hydraulic adjusting device are disadvantageous, since there is the possibility of leakage at each seal situated in the system. A malfunction of the valve can have serious consequences. Furthermore, volume changes of the hydraulic fluid are brought about by the temperature variations present in flight operation, which volume changes in the case of the hydraulic locking could lead to the exit of hydraulic fluid due to positive pressure or the entry of ambient air due to negative pressure.

Furthermore, frictional lockings via various clamping principles are known. The disadvantage of these is the high Hertzian pressure necessary to provide the required holding power. Moreover, the constructive expenditure of the clamping connections is extremely high and results in a high structural weight. The disadvantage of clamping connections is their tendency to be irreversible, so that after a locking, a release of the clamping connections is impossible or only possible with great difficulty.

From DE 31 33 117 C2 a support strut for retractable aircraft landing gear, the length of which strut can be changed telescopically, is known in which when a landing gear is completely retracted, a locking takes place in the end position by means of form-fitting. Locking in a non-retracted position is not possible.

SUMMARY OF THE INVENTION

The present invention provides a locking device for linear actuators, in particular for fluid-actuated adjusting devices, with a piston rod mounted in an axially displaceable manner relative to a receiving device, with which piston rod a secure locking is possible over the entire travel path of the linear actuators.

This is attained according to the invention by a locking device with the features of claim 1, in which the piston rod has a hollow space extending in the axial direction, in which form-fitting devices are arranged distributed in the axial direction. In addition, form-fitting elements corresponding to the form-fitting devices are arranged in the piston rod in a radially displaceable manner, which elements are mounted in an axially stationary manner relative to the receiving device. An actuating device that displaces the form-fitting elements radially is assigned to the form-fitting elements. It is thus possible via the actuating device to bring the form-fitting elements into form-fitting engagement with the form-fitting devices inside the piston rod, so that a form-fitting locking is possible inside the piston rod at discrete points over the entire travel path. It is thus possible to enable a secure locking of the linear actuators without a hydraulic locking and with a minimal constructive expenditure. Moreover, the mechanical locking through form-fitting inside the piston rod offers the possibility of a protected accommodation of the locking mechanism.

A further development of the invention provides that the form-fitting devices inside the piston rod are embodied as grooves, in particular radially peripheral grooves. In order to avoid a notch effect inside the piston rod and in order not to impair the stability of the piston rod, the form-fitting devices are embodied in the shape of groove rings that are inserted arranged behind one another in the piston rod. In the hollow piston rod, individual rings of different diameter or rings with recessed grooves are introduced and fixed therein. In addition, this has the advantages of a simple manufacture and easy assembly.

A further development of the invention provides that the receiving device for the piston rod is a cylinder, in particular a hydraulic or pneumatic cylinder, in which a piston fixed to the piston rod is mounted displaceably. The piston can be acted on by pressure on both sides, so that the piston rod is mounted so that it can be displaced to and fro in the axial direction.

Moreover it is provided that the form-fitting elements are embodied radially spring-mounted or mounted radially spring-mounted, in order to be able to actuate a reversibility of the form-fitting engagement simply. It is possible thereby that the form-fitting elements are held under tension disengaged from the form-fitting devices during the operation of the linear actuator and that after the tension has been released, the form-fitting elements are brought by the spring force into engagement with the form-fitting devices. Alternatively it is provided that the form-fitting elements are disengaged in the relaxed position and are brought into the form-fitting engagement with the form-fitting devices only by the actuating device. After removal of the actuating device or after a movement back into the starting position, the form-fitting elements spring back into the relaxed position, so that the free movability of the actuator or the adjusting device is again provided.

One embodiment of the invention provides that the form-fitting elements are projections arranged or embodied on a holder. Alternatively, the form-fitting elements are segments mounted displaceably, which segments are displaced radially, or are spring washers embodied radially spring-mounted that either spring into the form-fitting devices or spring out of them.

An advantageous variant of the invention provides that the holder is embodied as a spreader sleeve that is provided with slots in the axial direction so that the slotted sections can be displaced radially. The form-fitting elements are embodied or arranged on the slotted sections, preferably at the ends of the sections, so that a locking of the piston rod relative to the holder or to the receiving device is possible over the entire displacement area of the piston rod. The form-fitting elements are thereby mounted on the holder in an axially stationary manner relative to the receiving device. The holder or the spreader sleeve is enclosed by the piston rod at least in the area of the form-fitting elements, so that the form-fitting elements can engage in the form-fitting devices symmetrically, preferably in a circumferential circle inside the piston rod.

In order to achieve a radial displacement of the form-fitting elements in a simple and reliable manner, the actuating device is embodied as an axially displaceable gripping cone, by means of whose axial displacement the form-fitting elements are caused to engage with or disengage from the form-fitting devices of the piston rod. To this end it is provided that a mating cone complementary to the gripping cone is embodied on the spreader sleeve, via which mating cone the form-fitting elements are held disengaged from the form-fitting devices. An embodiment of this type is provided when the form-fitting elements are held disengaged under tension. To this end the gripping cone is embodied as a cap-shaped outer cone in which the mating cone engages. Alternatively it is provided that the gripping cone is embodied as an inner cone that is inserted into a funnel-shaped mating cone of the spreader sleeve. Through an axial displacement of the gripping cone the spreader sleeve is widened and the form-fitting elements are brought into engagement with the form-fitting devices.

In order to prevent the form-fitting elements from escaping radially inwards when the elements are engaged with the form-fitting devices, a tension and locking sleeve is arranged inside the spreader sleeve as a support sleeve, which support sleeve in the locked state is displaced into the area of the slotted sections and exerts a supporting action. To this end it is provided that the gripping cone is coupled with the tension- and locking sleeve via a spring-loaded tension anchor, so that the tension and locking sleeve is displaced via a spring automatically when the tension and locking sleeve is released.

BREIF DESCRIPTION OF THE DRAWINGS

An exemplary embodiment of the invention is described in more detail below based on the attached figures. These figures show:

DETAILED DESCRIPTION OF THE PRESENT INVENTION

Figure 1:
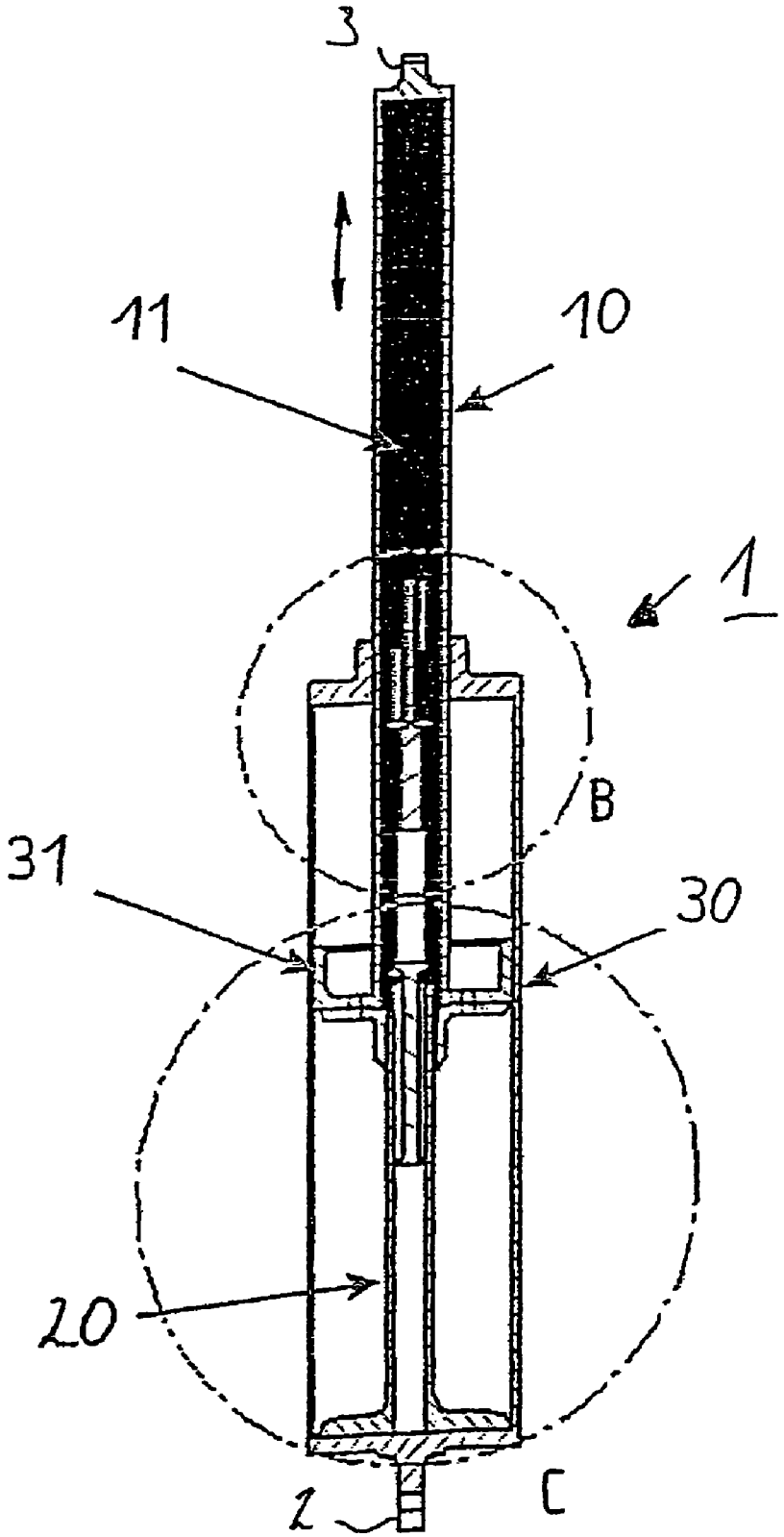
FIG. 1 shows a cross-sectional view of a hydraulic adjusting device.

FIG. 1 shows a linear actuator 1, in this case a hydraulic adjusting device, with a piston rod 10 that is guided displaceably in a receiving device 30 embodied as a cylinder. The two ends 2, 3 of the adjusting device 1 have fixing devices that can be attached to objects that are to be mounted movably relative to one another. The cylinder 30 serving as receiving device for the piston rod 10 is a hydraulic cylinder in which a piston 31, which is fixed to the piston rod 10, can be moved in the direction of the double arrow. On the side of the cylinder 30 facing away from the piston rod 10, a holder 20 is fixed that runs through the piston 31 and projects into a hollow space 11 of the piston rod 10. On the end of the holder 20 on the piston rod side, form-fitting elements (not shown) are embodied that if required engage in form-fitting devices (likewise not shown) inside the piston rod 10. A form-fitting locking of the piston rod 10 relative to the cylinder 30 or the holder 20 takes place, whereby the locking can be undertaken in almost every position of the piston rod 10 relative to the cylinder 30, since the form-fitting devices are composed of grooves arranged axially behind one another, which grooves are arranged in the exemplary embodiment in the hollow space 11 over the entire length of the piston rod 10. In the state shown, the form-fitting elements of the holder 20 are disengaged from the form-fitting devices inside the piston rod 10, so that the piston rod 10 is freely movable axially. The holder 20 is connected with the cylinder 30 or with the cylinder housing and attached to the latter, so that the form-fitting elements are also fixed immovably to the cylinder housing 30 in the axial direction.

Figure 2:
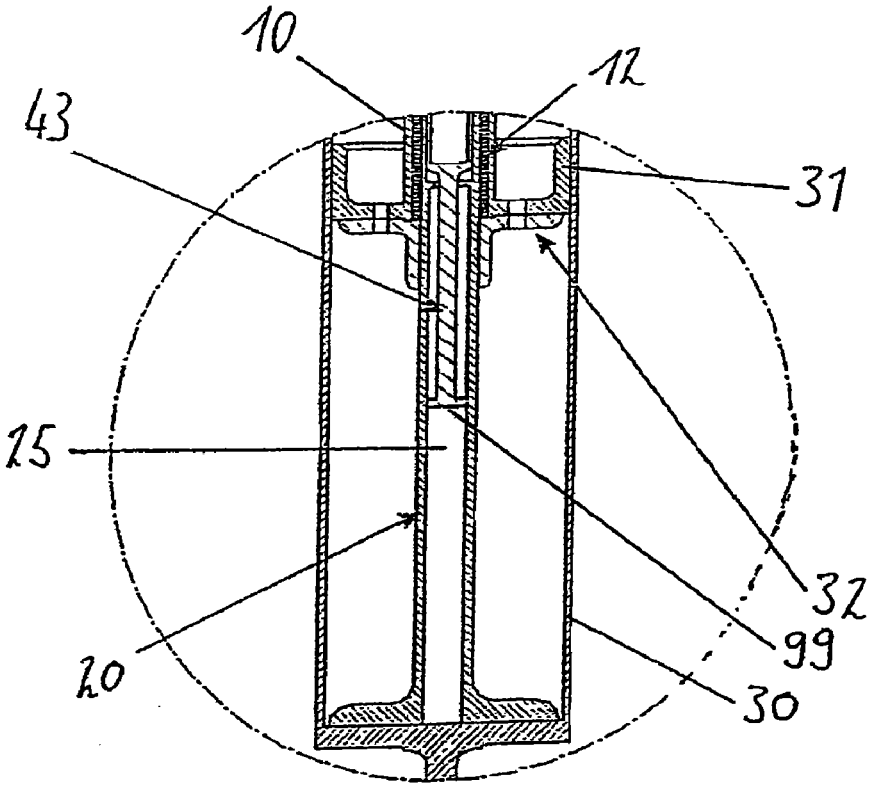
FIG. 2 shows detail C of FIG. 1.

In FIG. 2 the detail C of FIG. 1 is illustrated in an enlarged scale and shows in a cross-sectional view the cylinder housing 30 with the holder 20 fixed therein. The holder 20 has a central bore 25 in which a tension anchor 43 for a tension and locking sleeve (not shown) is arranged in a longitudinally displaceable manner, which sleeve is held stationary via a holding device 99. A base plate 32 that is fixed to the piston 31 is arranged around the outer wall of the holder 20. The piston 31 in turn is fixed to the piston rod 10, which has form-fitting devices 12 in its interior. The form-fitting devices 12 are embodied in the form of groove rings that are layered behind one another inside the hollow space 11 of the hollowed-out piston rod 10. The groove rings 12 are held in the piston rod 10 by means of the base plate 32. The groove rings 12 embody peripheral grooves. The piston rod 10 and the groove rings 12 are dimensioned such that the piston 31 and the base plate 32 can slide along on the holder 20. In combination with the base plate 32, the piston 31 serves as a guide for the holder 20, which in this way obtains a better buckling strength.

Figure 3:
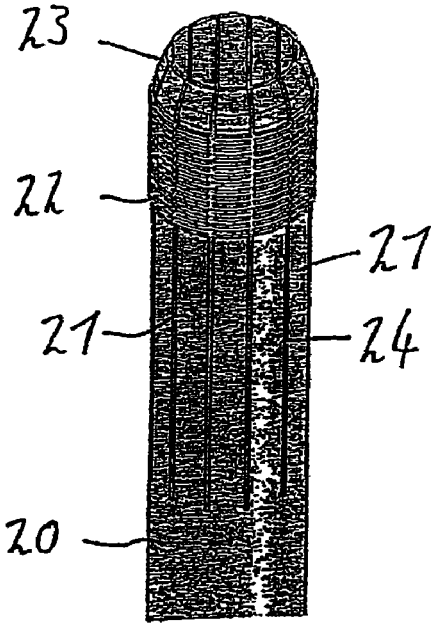
FIG. 3 shows a detailed view of a spreader sleeve.

On the upper end of the holder 20 (not shown) a spreader sleeve is embodied, as shown in FIG. 3. The spreader sleeve 20 is composed thereby of slotted sections 21 that are formed by cuts 24 running axially. The slotted sections 21 are radially displaceable and have form-fitting elements 22 on their exterior in the form of elevations or catches. The upper termination of the spreader sleeve 20 is formed by a mating cone 23 that tapers upwards.

Figure 4:
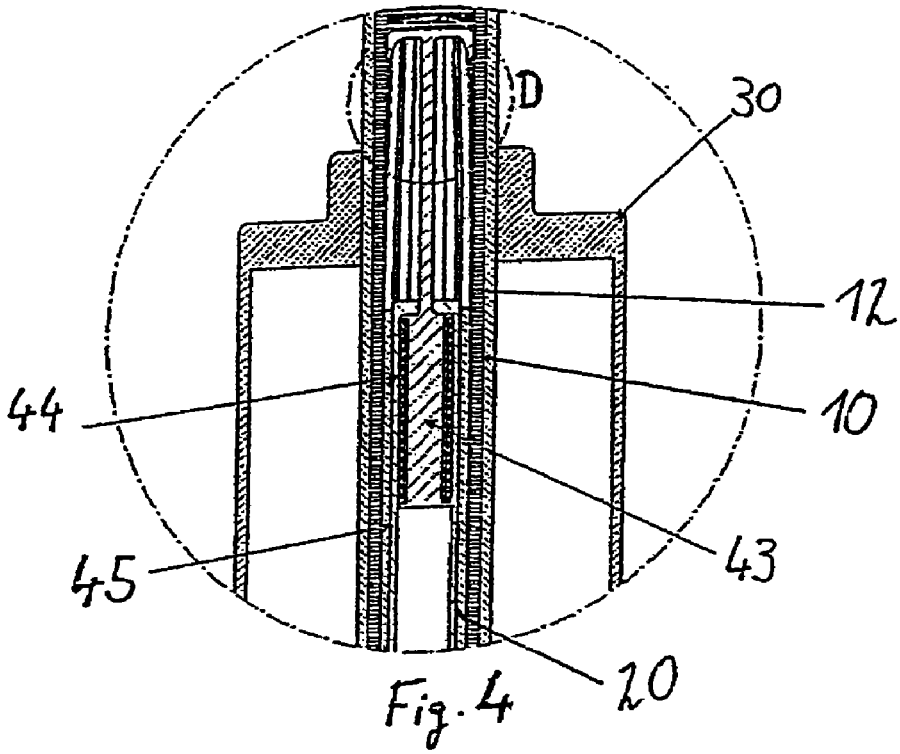
FIG. 4 shows detail B in FIG. 1.

In FIG. 4 the detail B of FIG. 1 is shown, in which the cylinder housing 30 with the piston rod 10 mounted displaceably therein can be seen. The form-fitting devices 12 in the form of groove rings are inserted in the hollow space of the piston rod 10; alternatively, the grooves can be recessed in the piston rod 10. Moreover, the grooves can be embodied as screw threads (acme threads or the like), for example as an internal thread inside the piston rod 10. The form-fitting elements can be embodied on the spreader sleeve 20 as an external thread. The holder 20, which is embodied as a tube, is guided inside the piston rod 10 and inside the groove rings 12. In the holder 20 a tension- and locking sleeve 45 is mounted displaceably. Inside the tension and locking sleeve 45, a tension anchor 43 is mounted that is loaded in the direction of the cylinder-side end of the holder 20 via a spiral spring 45. The spreader sleeve shown in FIG. 3 is embodied at the piston rod-side end of the holder 20, which spreader sleeve is enclosed by the front end of the tension anchor 43. The front end of the tension anchor 43 is provided with a gripping cone that displaces the mating cone 23 radially inwards by applying an axial force, so that the outside diameter of the spreader sleeve 20 is decreased. The form-fitting elements 22 are thus disengaged from the form-fitting devices 12, so that the piston rod 10 is freely movable axially.

Figure 5:
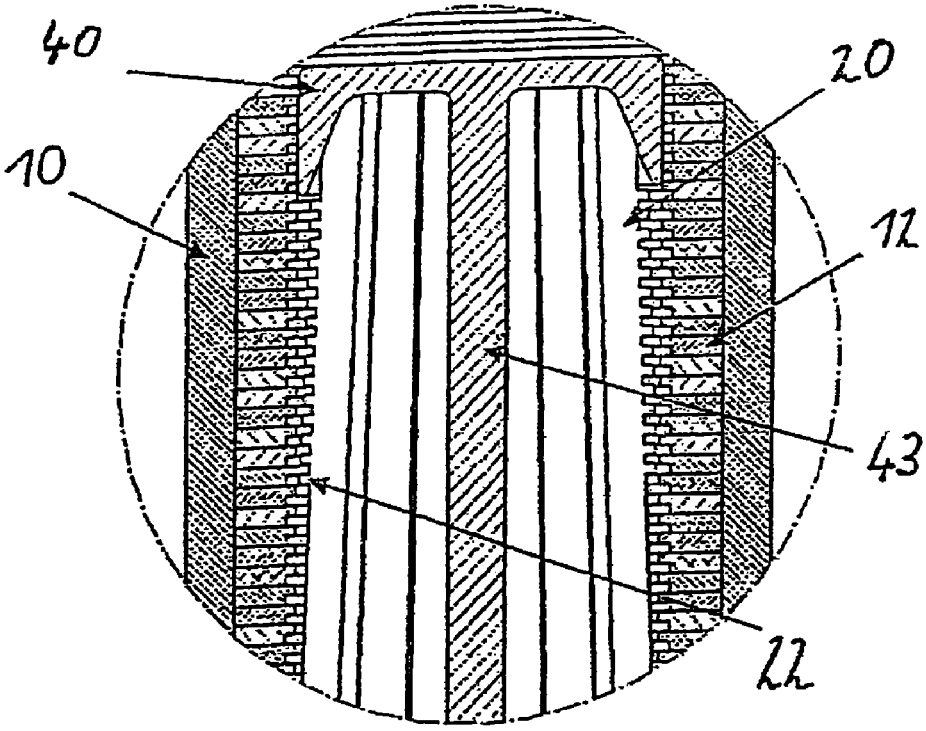
FIG. 5 shows detail D in FIG. 4.

In FIG. 5 the detail D of FIG. 4 is shown, based on which it can be seen that the gripping cone 40 as an actuating device displaces the mating cone 23 of the spreader sleeve 20 radially inwards. In this state the spreader sleeve 20 is tensioned and the linear actuator 1 is freely movable. If the axial holding force on the tension and locking sleeve 45 is eliminated in that a holding device 99 as indicated in FIG. 2 is released, because of the radial tension of the slotted sections 21 of the spreader sleeve 20 the tension anchor 43 is displaced in the direction of the piston rod 10 due to the action of the mating cone 23 on the gripping cone 40. The spreader sleeve 20 relaxes and the slotted sections 21 spring radially outwards. This causes the form-fitting elements 22 to engage with the form-fitting devices 12 and to lock the piston rod 10 in this position. The catches or the projections 22 press against the groove rings 12 due to the internal stress brought about by the spring action of the slotted sections 21, as well as due to the tension and locking sleeve 45 loaded by the coil spring, which tension- and locking sleeve 45 exerts a wedge action on the inner flank of the spreader sleeve 20, which is still deformed inwardly. In so far as the grooves and the projections or catches lie opposite one another, a locking into position occurs. After the locking into position of the form-fitting elements 22 in the groove rings 12, a cylindrical geometry is present inside the slotted sections 21 of the spreader sleeve 20. Now the cylindrical tension and locking sleeve 45, driven by the tensioned coil spring 44, is displaced completely into the slotted area of the spreader sleeve 20. The tension- and locking sleeve 45 is supported thereby via the coil spring 44 on the tension anchor 43, via the gripping cone 240 and the mating cone 23 axially on the mating cone 23. A slipping back of the tension- and locking sleeve is thus prevented. By these means the slotted sections 21 of the spreader sleeve 20 are prevented from buckling inwards. To unlock the locking, the tension- and locking sleeve 45 is transported in the opposite direction, i.e. in the direction of the cylinder 30, the coil spring 44 is prestressed. Then the tension anchor 43 is moved concomitantly in a form-fitting manner through the tension- and locking sleeve 45, the gripping cone 40 engages with the mating cone 23 and displaces the slotted sections 21 radially inwards. The form-fitting elements 22 are thus disengaged from the form-fitting devices 12 and the adjusting device 1 is freely movable axially.

The locking device can be used wherever an axial movement must be blocked reversibly, in a form-fitting manner, and if possible over the entire travel path. An extremely fine gradation of the form-fitting locking is possible through the arrangement of the groove rings 12 behind one another. A very good protection from external influences is provided by the locking device arranged inside the cylinder 30. The entire system is closed, so that damage caused by external influences is almost excluded. The reversible locking at discrete positions over the entire travel path of the adjusting device 1 is guaranteed, so that its use is possible even for safety-critical applications. The actuation of the tension- and locking sleeve 45 can take place through the central bore 25 of the holder 20, for example by hydraulic or electromotive means. An emergency actuation through a detonator is likewise possible.

Alternatively to a hydraulic adjusting device, all linear actuators can be equipped thus. Instead of the version shown of the form-fitting elements 22 held disengaged, it is provided to embody the gripping cone such that it widens the spreader sleeve 20. Likewise it is possible for latches or segments mounted displaceably, to be arranged inside the spreader sleeve 20 or the holder, which latches or segments are engaged with the form-fitting devices 12 in a form-fitting manner, in that these spring-mounted segments are pressed outwards by a cone. If spring washers are used, these can be held disengaged in an analogous manner and can be unlocked if required.

The invention claimed is:

1. A locking device for linear actuators, comprising:

a piston rod mounted in an axially displaceable manner relative to a receiving device, the piston rod having a hollow space extending in an axial direction, and having form-fitting devices being arranged in the axial direction in the hollow space;

form-fitting elements corresponding to the form-fitting devices arranged in the piston rod in a radially displaceable manner, the form-fitting elements being mounted in an axially stationary manner relative to the receiving device; and an actuating device displacing the form-fitting elements radially and being assigned to the form-fitting elements, wherein the actuating device is embodied as an axially displaceable gripping cone.

2. The locking device according to claim 1, wherein the form-fitting devices are grooves.

3. The locking device according to claim 1 wherein the form-fitting devices are groove rings arranged behind one another in the piston rod.

4. The locking device according to claim 1, wherein the receiving device is a cylinder in which a piston fixed to the piston rod is mounted displaceably.

5. The locking device according to claim 1, wherein the form-fitting elements are embodied or mounted radially spring-mounted.

6. The locking device according to claim 1, wherein the form-fitting elements are projections arranged or embodied on a holder, segments mounted displaceably, or spring washers embodied radially spring-mounted.

7. The locking device according to claim 6, wherein the form-fitting elements are mounted on the holder in an axially stationary manner relative to the receiving device, and the holder is enclosed by the piston rod at least in an area of the form-fitting elements.

8. The locking device according to claim 1, further comprising a mating cone complementary to the gripping cone embodied on a holder, wherein the mating cone and the form-fitting elements are held disengaged from the form-fitting devices.

9. The locking device of claim 8, wherein the holder is a spreader sleeve.

10. The locking device according to claim 1, further comprising a tension and locking sleeve that prevents an escape of the form-fitting elements radially inwards, the tension and locking sleeve being arranged inside a holder.

11. The locking device of claim 10, wherein the holder is a spreader sleeve.

12. The locking device of claim 11, wherein the tension and locking sleeve is arranged inside the spreader sleeve.

13. The locking device of claim 1, wherein the locking device is configured for fluid-actuated adjusting devices.

14. A locking device for linear actuators, comprising:

a piston rod mounted in an axially displaceable manner relative to a receiving device, the piston rod having a hollow space extending in an axial direction, and having form-fitting devices being arranged in the axial direction in the hollow space;

form-fitting elements corresponding to the form-fitting devices arranged in the piston rod in a radially displaceable manner, the form-fitting elements being mounted in an axially stationary manner relative to the receiving device; and an actuating device displacing the form-fitting elements radially and being assigned to the form-fitting elements, wherein the form-fitting elements are projections arranged or embodied on a holder, segments mounted displaceably, or spring washers embodied radially spring-mounted and the holder is a spreader sleeve that includes slotted sections in the axial direction and the form-fitting elements are arranged on the slotted sections.

15. The A locking device for linear actuators, comprising:

a piston rod mounted in an axially displaceable manner relative to a receiving device, the piston rod having a hollow space extending in an axial direction;

form-fitting devices being arranged in the axial direction;

form-fitting elements corresponding to the form-fitting devices arranged in the piston rod in a radially displaceable manner, the form-fitting elements being mounted in an axially stationary manner relative to the receiving device; and an actuating device displacing the form-fitting elements radially and being assigned to the form-fitting elements;

a tension and locking sleeve that prevents an escape of the form-fitting elements radially inwards, the tension and locking sleeve being arranged inside a holder, wherein the actuating device is embodied as an axially displaceable gripping cone, and the gripping cone is coupled with the tension and locking sleeve via a spring-loaded tension anchor.

16. A locking device for linear actuators, comprising:

a piston rod guided displaceably in a cylinder, the piston rod having a hollows space which includes form fitting devices in the hollow space;

a spreader sleeve holder being fixed and which projects into the hollow space of the piston rod, on a side of the cylinder facing away from the piston rod; and form-fitting elements engaging in the form-fitting devices inside the hollow space of the piston rod, on an end of the spreader sleeve holder on a side of the piston rod, the form-fitting devices being composed of grooves arranged axially behind one another, wherein the form-fitting elements are mounted in an axially stationary manner relative to the cylinder.

17. The locking device according to claim 16, wherein the grooves are arranged axially behind one another over the entire length of the piston rod.

18. A locking device for linear actuators, comprising:

a piston rod guided displaceably in a cylinder;

a holder being fixed and which projects into a hollow space of the piston rod, on a side of the cylinder facing away from the piston rod; and form-fitting elements engaging in form-fitting devices inside the piston rod, on an end of the holder on a side of the piston rod, the form-fitting devices being composed of grooves arranged axially behind one another, wherein the holder has a central bore in which a tension anchor for a tension and locking sleeve is arranged in a longitudinally displaceable manner.

19. A locking device for linear actuators, comprising:

a piston rod guided displaceably in a cylinder, the piston rod having a hollows space which includes form fitting devices in the hollow space;

a holder being fixed and which projects into the hollow space of the piston rod, on a side of the cylinder facing away from the piston rod; and form-fitting elements engaging in the form-fitting devices inside the hollow space of the piston rod, on an end of the holder on a side of the piston rod, the form-fitting devices being composed of grooves arranged axially behind one another, wherein the grooves are one of groove rings layered behind one another inside the piston rod, recessed grooves and screw threads, and the groove rings are held in the piston rod by a base plate, the groove rings are dimensioned such that the piston and the base plate can slide along on the holder.

20. A locking device for linear actuators, comprising:

a piston rod guided displaceably in a cylinder, the piston rod having a hollows space which includes form fitting devices in the hollow space;

a holder being fixed and which projects into the hollow space of the piston rod, on a side of the cylinder facing away from the piston rod;

form-fitting elements engaging in the form-fitting devices inside the hollow space of the piston rod, on an end of the holder on a side of the piston rod, the form-fitting devices being composed of grooves arranged axially behind one another; and a spreader sleeve on an upper end of the holder which is composed of slotted sections which are radially displaceable and have the form-fitting elements on their exterior in a form of elevations or catches.

21. The locking device according to claim 20, wherein an upper termination of the spreader sleeve is formed by a mating cone that tapers upwards.

22. The locking device according to claim 21, wherein the holder includes a central bore in which a tension anchor for a tension and locking sleeve is arranged in a longitudinally displaceable manner.

23. The locking device according to claim 22, wherein a front end of the tension anchor is provided with a gripping cone that displaces a mating cone radially inwards by applying an axial force, so that an outside diameter of a spreader sleeve is decreased.

24. A locking device for linear actuators, comprising:

a piston rod guided displaceably in a cylinder, the piston rod having a hollows space which includes form fitting devices in the hollow space;

a holder being fixed and which projects into the hollow space of the piston rod, on a side of the cylinder facing away from the piston rod; and form-fitting elements engaging in the form-fitting devices inside the hollow space of the piston rod, on an end of the holder on a side of the piston rod, the form-fitting devices being composed of grooves arranged axially behind one another, wherein the form-fitting elements are embodied on a spreader sleeve as an external thread.

* * * * *